US005351792A

United States Patent [19]

Cohen

[11] Patent Number: 5,351,792

[45] Date of Patent: Oct. 4, 1994

[54] WHEELED STACKABLE LUGGAGE

[76] Inventor: Fred E. Cohen, 2201 Banyan Dr., Los Angeles, Calif. 90049

[21] Appl. No.: 165,664

[22] Filed: Dec. 13, 1993

[51] Int. Cl.[5] ..... A45C 13/26

[52] U.S. Cl. ..... 190/18 A; 190/37; 280/47.34

[58] Field of Search ..... 190/18 R, 18 A, 25, 190/37, 113; 280/47.34

[56] References Cited

U.S. PATENT DOCUMENTS

| | | | |
|---|---|---|---|
| 2,187,270 | 1/1940 | Kirk | 280/47.34 |
| 2,626,652 | 1/1953 | Steigler | 280/47.34 X |
| 3,201,139 | 8/1965 | Turnington | 280/47.34 X |
| 3,540,614 | 11/1970 | Flagg | 280/47.34 X |
| 5,114,895 | 5/1992 | Myers | 190/123 X |
| 5,154,265 | 10/1992 | Capistrant | 190/18 A |
| 5,222,748 | 6/1993 | Johnson | 280/47.34 X |
| 5,253,739 | 10/1993 | King | 190/18 A |

FOREIGN PATENT DOCUMENTS

| | | | |
|---|---|---|---|
| 2171674 | 9/1986 | United Kingdom | 190/18 A |

*Primary Examiner*—Allan N. Shoap
*Assistant Examiner*—Christopher T. McDonald

[57] ABSTRACT

A piece of luggage in the form of a suitcase of a rectangular configuration having a flat top, a flat bottom and flat sides. Four wheels are mounted at the corners of the bottom. Elongated rigid arcuate members are mounted on the corners of the suitcase and each extends from the top of the suitcase to a plane beyond the bottom of the suitcase to protect the wheels. The top of the suitcase is formed of a soft fabric material with a zippered portion to permit access to the interior of the suitcase. A pull strap and a carrying handle are provided. A rigid plastic tray is mounted inside the suitcase and engages the bottom and the sides to provide strength and rigidity to the suitcase.

9 Claims, 2 Drawing Sheets

FIG. 1
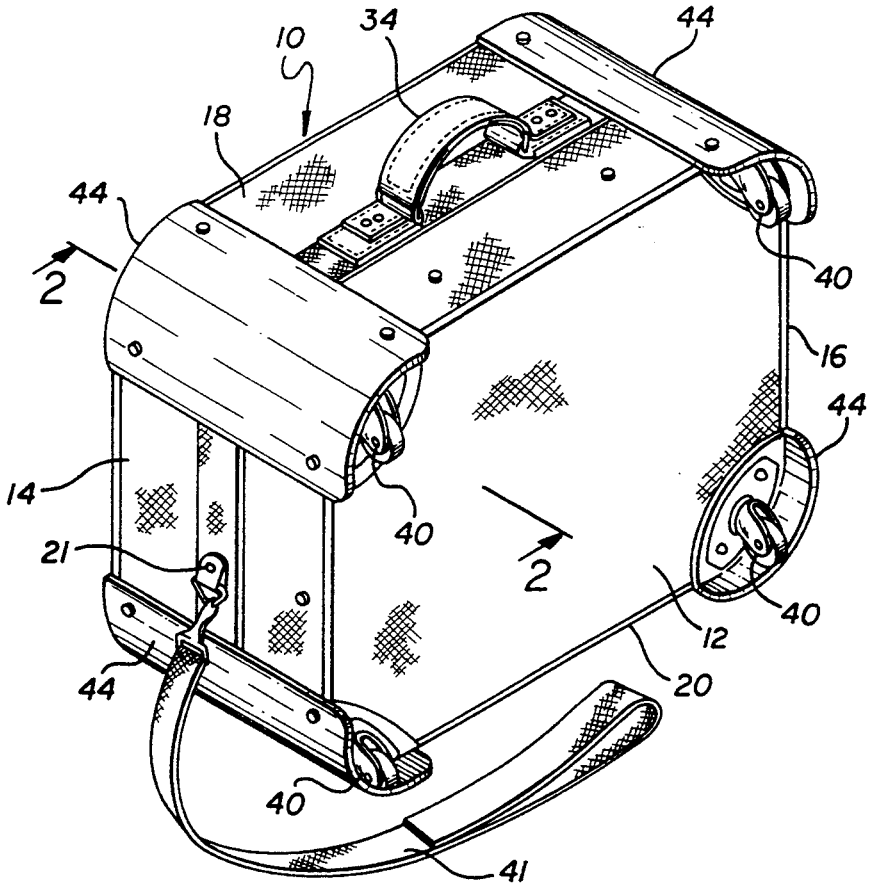
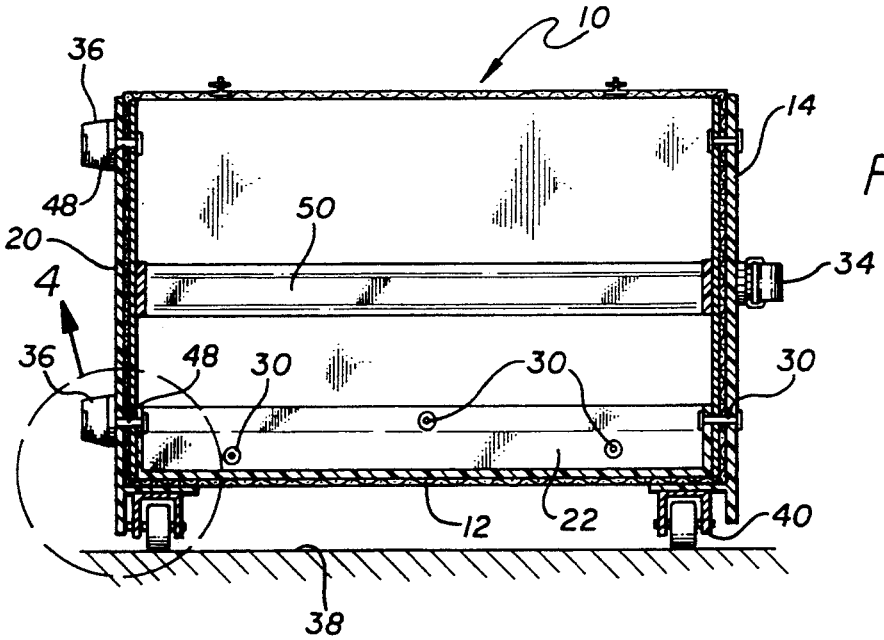
FIG. 2

WHEELED STACKABLE LUGGAGE

BACKGROUND OF THE INVENTION

The invention is directed to wheeled luggage, and particularly to a combination of hard and soft luggage in the form of a suitcase having a rectangular configuration to permit stacking with other similar suitcases, and which has four wheels mounted on its bottom at the respective corners to provide stability when rolled over a supporting surface, and so that there is no tendency for the suitcase to tip over. The front two wheels, or all four wheels, may be capable of being swiveled so that the suitcase may be easily maneuvered when it is pulled along the supporting surface.

The piece of luggage of the invention has hard corners and a hard base formed, for example, of plastic, and it has a soft fabric top including a zippered portion to permit access to the interior of the suitcase. The hard corners extend downwardly beyond the plane of the bottom to protect the wheels from striking curbs, and the like, and thereby to avoid damage to the wheels.

A strap is attached to one end of the unit for pulling the suitcase on its wheels. A handle is also provided on one side for carrying the suitcase unit, and rails are mounted on the opposite side for supporting the suitcase in an upright position.

It is, accordingly, an objective of the present invention to provide a rugged piece of luggage, such as a suitcase, which has protected wheels, and which has a configuration that enables it to be stacked on other similar pieces of luggage.

BRIEF DESCRIPTION OF THE DRAWINGS

FIG. 1 is a perspective view of an article of luggage, such as a suitcase, having a soft fabric top and a rigid lower portion and which is constructed in accordance with one embodiment of the present invention, the view being taken from the bottom and to one side of the suitcase;

FIG. 2 is a sectional view of the suitcase of FIG. 1 taken essentially along the line 2–2 of FIG. 1 and turned 90 degrees;

DETAILED DESCRIPTION OF THE ILLUSTRATED EMBODIMENTS

Figure 3:
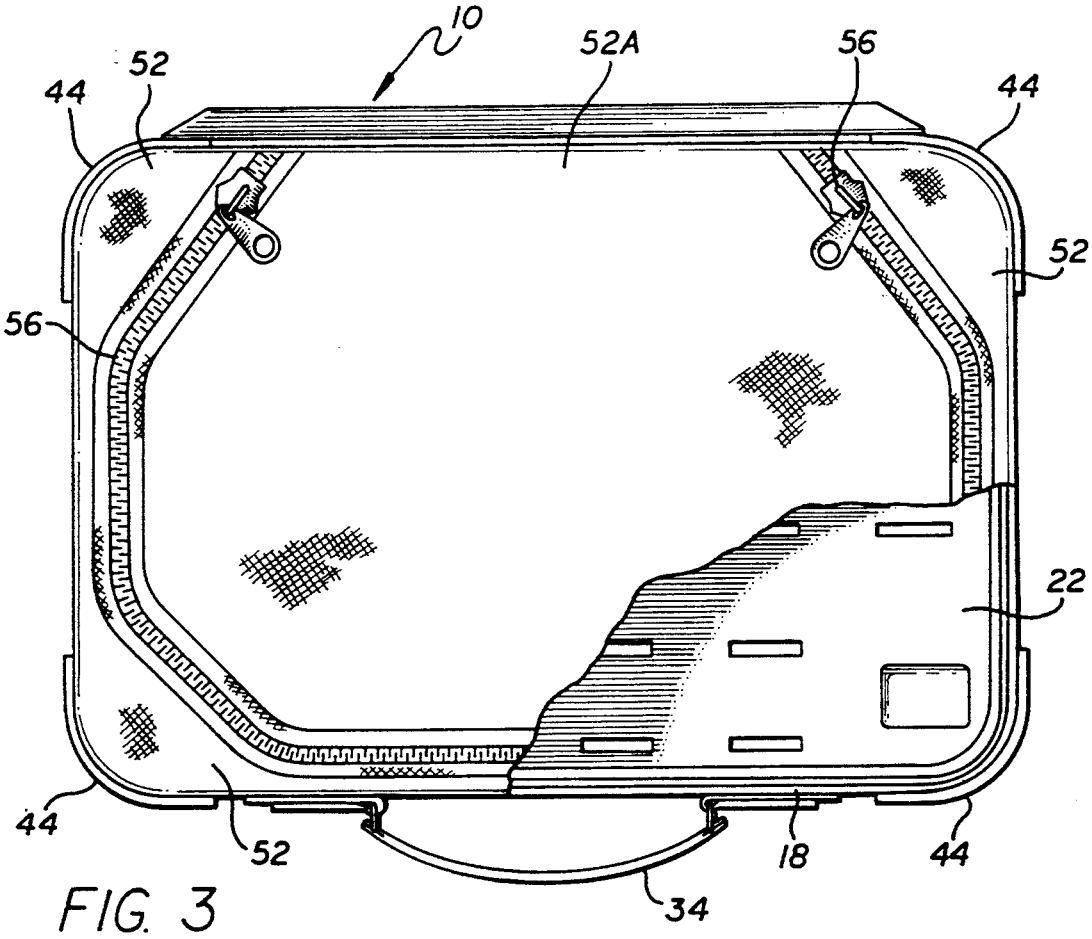
FIG. 3 is a top view of the suitcase of FIG. 1, showing the fabric top cut away to reveal a solid plastic member which is mounted inside the unit and which provides the rigid lower portion of the suitcase.
Figure 4:
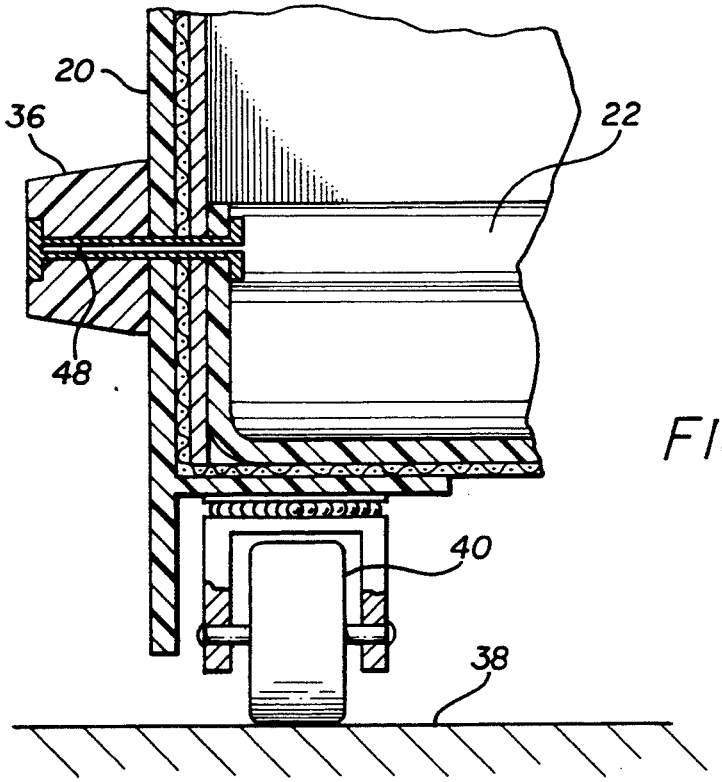
FIG. 4 is an enlarged sectional view of the portion of the suitcase of FIG. 2 indicated by the numeral 4.

The suitcase of the present invention, as illustrated in the drawings, is designated generally as 10. The suitcase 10 has a reinforced fabric bottom 12, and reinforced fabric sides 14 and 16. The suitcase also has reinforced fabric sides 18 and 20. A plastic insert 22 is mounted within the suitcase to reinforce the lower portion of the suitcase and make it rigid. The member 22 has a flat bottom and upstanding edges which are secured to the sides of the suitcase 10 by rivets 30.

A carrying handle 34 is attached to side 18 so that the suitcase may be carried in an upright position. A pair of rails 36 are attached to the opposite side 20 for supporting the suitcase in an upright position when it is placed down on a supporting surface 38. A pull strap 41 is attached to the side 14 of the suitcase by a usual swivel mount.

The suitcase may be turned on its bottom 12 to be supported by four wheels 40 mounted at the corners of the bottom, and when the suitcase is turned on its bottom, it may be pulled along the supporting surface 38 by the pull strap 41 and, as such, the suitcase is extremely stable and not subject to tilt. All four of the wheels 40 may be mounted on the bottom for swivel movement, or just the forward wheels may be so mounted, if so desired.

As best shown in FIG. 1, elongated arcuate members, such as members 44, are mounted on the four corners of the suitcase and extend from the top of the suitcase to a plane below the bottom 12, so as to provide protection for the wheels 40. This is extremely important, since otherwise the wheels would have a tendency to break when the suitcase is pulled against a curb or other obstruction. The rails 30 are held in place by support fasteners, such as the fasteners 48.

A rigid plastic support bracket 50 is provided which is secured to the sides of the suitcase and which encircles the interior of the suitcase midway between the top and bottom and adjacent to the swivel coupling 21 which couples the pull strap 41 to the side 14 of the suitcase.

The top of the suitcase is formed of soft fabric material, and is designated 52. A portion of the top is cut away to form a plastic flap 52A which is attached to the top 52 by a zipper 56. The flap 52A permits access to the interior of the suitcase.

The invention provides, therefore, a rugged and stable piece of luggage in the form of a suitcase which is sturdy in its construction. The suitcase of the invention features wheels provided on its bottom, so that the suitcase may be pulled along a supporting surface and not be subject to tilting. The suitcase also features a carrying handle secured to one of the sides, and support rails for the suitcase on the opposite side. The top of the suitcase is formed of soft fabric material, which is zippered in order to provide easy access to the interior of the suitcase. A plastic tray is mounted inside the suitcase adjacent to the bottom to provide added strength and rigidity to the lower portion of the suitcase.

It will be appreciated that while a particular embodiment of the invention has been shown and described, modifications may be made. It is intended in the claims to cover all such modifications which fall within the true spirit and scope of the invention.

I claim:

1. A piece of luggage in the form of a suitcase of a rectangular configuration and having a flat top, a flat bottom, and four flat sides; four wheels mounted on said bottom and extending downwardly therefrom at the respective corners thereof; at least two elongated rigid members mounted adjacent to at least two of the corners of the suitcase and extending to a plane below said bottom to protect said wheels, and in which said top is formed of a soft fabric material, and in which said top includes a zippered flap portion to permit access to the interior of the suitcase.

2. The piece of luggage defined in claim 1, in which each of said elongated rigid members has an arcuate configuration.

3. The piece of luggage defined in claim 1, and which includes four of said elongated rigid members mounted at the respective corners of the suitcase and each having an arcuate configuration.

4. The piece of luggage defined in claim 1, in which at least two of said wheels are mounted for swivel motion on the bottom of the suitcase.

5. The piece of luggage defined in claim 1, and which includes a rigid tray member mounted in said suitcase and engaging said bottom and at least a portion of said sides.

6. The piece of luggage defined in claim 5, in which said tray is formed of a plastic material.

7. The piece of luggage defined in claim 1, and which includes a pull strap attached to one of said sides.

8. The piece of luggage defined in claim 1, and which includes a carrying handle affixed to a first of said sides.

9. The article of luggage defined in claim 8, and which includes a pair of rigid support rails mounted and spaced in parallel relationship on a second of said sides opposite to said first side.

* * * * *